United States Patent [19]

Tone et al.

[11] Patent Number: 4,858,836

[45] Date of Patent: Aug. 22, 1989

[54] YARN END FINDING DEVICE

[75] Inventors: Shoichi Tone; Norio Kubota, both of Kyoto, Japan

[73] Assignee: Murata Kikai Kabushiki Kaisha, Kyoto, Japan

[21] Appl. No.: 129,539

[22] Filed: Dec. 7, 1987

[30] Foreign Application Priority Data

Dec. 12, 1986 [JP] Japan ..... 61-191467
Feb. 9, 1987 [JP] Japan ..... 62-27872

[51] Int. Cl.[4] ..... B65H 54/00

[52] U.S. Cl. ..... 242/18 R; 242/35.5 R; 242/35.6 E

[58] Field of Search ..... 242/18 R, 35.5 R, 35.5 A, 242/35.6 R, 35.6 E

[56] References Cited

U.S. PATENT DOCUMENTS 3,059,866 10/1962 Reiners ..... 242/35.6 E
3,236,464 2/1966 Wey ..... 242/35.6 E X
3,295,776 1/1976 Cruickshank et al. ..... 242/35.6 E
3,329,362 7/1967 Kieronski ..... 242/35.6 E
3,441,230 4/1969 Kupper ..... 242/35.6 E
3,544,017 12/1970 Stoppard et al. ..... 242/35.6 R
4,634,065 1/1987 Kupper et al. ..... 242/18 R
4,681,271 7/1987 Matsui et al. ..... 242/18 R
4,705,224 11/1987 Akiyama et al. ..... 242/35.6 E
4,735,369 4/1988 Suzuki ..... 242/18 R

*Primary Examiner*—Stanley N. Gilreath
*Attorney, Agent, or Firm*—Spensley Horn Jubas & Lubitz

[57] ABSTRACT

A device for finding an end of a yarn whereby an end of a yarn connecting to a layer of the yarn on a bobbin is found and is inserted into a center hole of a bobbin. The device includes an air flow controlling plate located near an outer periphery of a layer of a yarn on a spinning bobbin and a compressed air injection nozzle located in a gap between the air flow controlling plate and the yarn layer of the spinning bobbin.

13 Claims, 6 Drawing Sheets

YARN END FINDING DEVICE

FIELD OF THE INVENTION AND RELATED ART STATEMENT

This invention relates to a device for finding an end of a yarn.

When a spinning bobbin doffed on a spinning frame is to be supplied to a next rewinding step at an automatic winder, bunch windings wound around an end portion of a take-up tube of a spinning bobbin are released in advance to prepare for finding an end of a yarn so as to enable subsequent automatic yarn joining in a winder.

In this instance, there are various types of bobbins including a type wherein an end of a yarn exists at a portion of a bobbin at which bunch windings are located and another type wherein an end of a yarn is wound lightly in several turns on a surface of a yarn layer on a bobbin in such a manner as to form so-called back winds after bunch windings have been wound around an end portion of a take-up tube, which both depend upon spinning frames on which the bobbins are produced. There also exist bobbins which have been supplied once to a winder but discharged from the winder due to failure in yarn joining thereof and are thus supplied again to a yarn end finding device. Such a bobbin has no bunch windings thereon and may have an end of a yarn which is wound around or depends from an outer periphery of a layer of the yarn on the bobbin.

When ends of yarns on bobbins of such various types are to be found, particularly an end of a yarn wound around or depending from an outer periphery of a layer of the yarn on a bobbin may not always successfully be picked up on a yarn end finding device which acts only upon a location around the position of bunch windings on the bobbin.

Furthermore, it is a problem of the conventional yarn end finding device that an end of a yarn is ocasionally not inserted to a predetermined position in a step of inserting a yarn connecting to a layer of the yarn on a bobbin into a center hole of the bobbin.

OBJECT AND SUMMARY OF THE INVENTION

It is an object of the present invention to provide a yarn end finding device whereby finding of an end of a yarn is made possible for almost all bobbins.

It is another object of the present invention to provide a yarn end finding device in which detecting successful finding of an end of yarn is enabled.

According to the present invention, there is provided a device for finding an end of a yarn, which is constituted such that it comprises an air flow controlling plate located near an outer periphery of a layer of a yarn on a spinning bobbin at a yarn end picking up position and extending in a direction of an axis of the spinning bobbin, and a compressed air injection nozzle located in a gap between the air flow controlling plate and the yarn layer on the spinning bobbin.

Then, in a step of introducing an end of a yarn on a bobbin into a center hole of the bobbin, the yarn is detected when it enters the center hole of the bobbin.

DETAILED DESCRIPTION OF THE INVENTION

Now, an embodiment of the present invention will be described with reference to the drawings.

Figure 1:
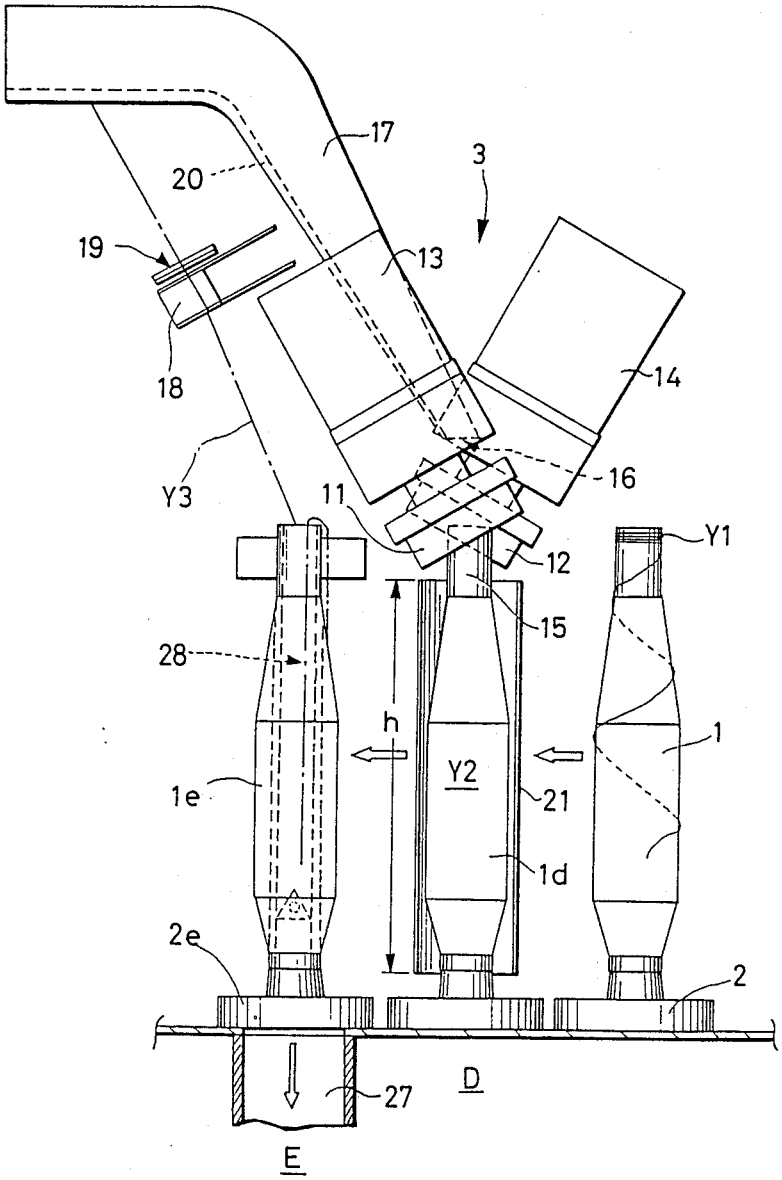
FIG. 1 is a front elevational view showing an embodiment of the present invention, FIG. 2 a perspective view of the embodiment of FIG. 1, FIG. 3 a top plan view of the embodiment of FIG. 1, FIG. 4 a front elevational view of an example of device for detecting successful finding of an end of a yarn, FIG. 5 a top plan view of the device of FIG. 4, FIG. 6 a perspective view showing a relation between a sensor and a bobbin, FIG. 7 a top plan view of the relation of FIG. 6, FIG. 8 an illustrative view showing a behavior of a yarn upon insertion of an end of the yarn, FIG. 9 a time chart showing operating timings of a cutter and the sensor, and FIG. 10 a perspective view of general construction showing an example of yarn end finding device.
Figure 2:
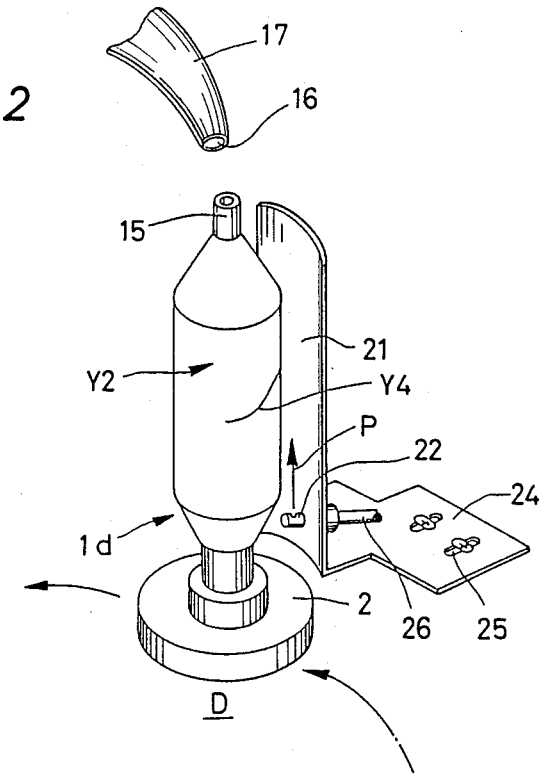
Figure 3:
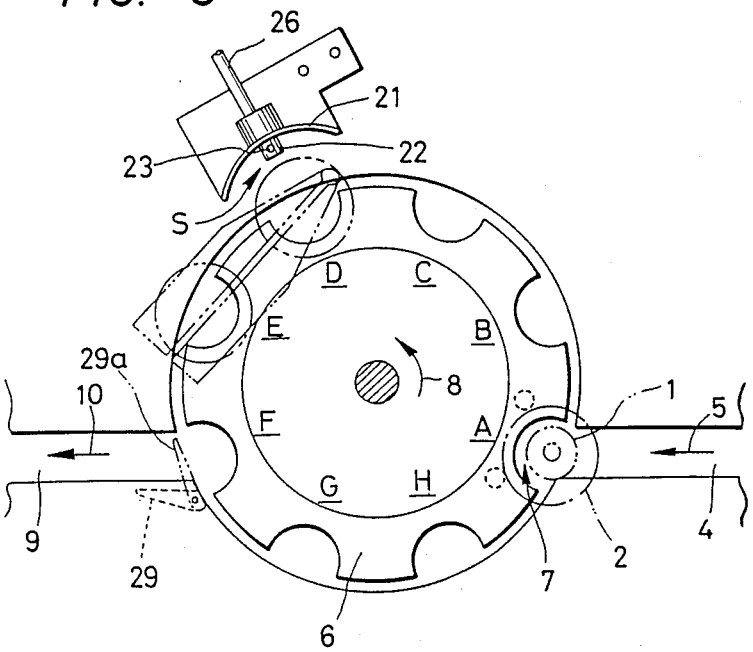

Referring to FIGS. 1 to 3, there is shown a case wherein spinning bobbins 1 produced on a spinning frame are transported on independent trays 2 on which they have been fitted uprightly one by one. Further, in the embodiment, a yarn end finding device 3 is shown which is applied to find an end of a yarn on a bobbin 1 which has thereon a so-called top bunch Y1 wherein bunch windings are located at a head portion of the bobbin 1.

Referring to FIG. 3, a bobbin 1 produced on the spinning frame is fed in a direction indicated by an arrow mark 5 along a transport path 4 until it comes to a bobbin accepting position A of the yarn end finding device while it is held fitted uprightly on a tray 2.

The bobbin 1 integral with the tray accepted in one of tray accepting portions 7 formed in a fixed pitch on a rotary plate 6 of the yarn end finding device passes, as the rotary plate 6 is rotated intermittently in a direction of another arrow mark 8, processing stations B, C, D and E and come to a discharging station F from which the bobbin for which an end of a yarn has been successfully found is transported in a direction indicated by a further arrow mark 10 along another transport path 9 toward a winder.

At the station D, a pair of rotary rollers 11, 12 for releasing a top bunch are provided such that axes of rotation thereof are inclined by individual certain angles relative to an axis of a bobbin. Reference numerals 13, 14 denote drive motors for the roller 11, 12, respectively. Thus, an upper end portion of a take-up tube 15 of a bobbin 1*d* is held between the rollers 11, 12 so that as the rollers are rotated in opposite directions, bunch windings Y1 at the upper end of the take-up tube are pushed upwardly along the take-up tube so that they are released from the take-up tube.

Further, a suction pipe 17 having an opening end 16 for sucking an end of a yarn is located above a bobbin at the yarn end finding position D. The suction pipe 17 has a slit 20 formed therein over a suitable distance from the opening end 16 thereof for guiding an end of a yarn to a yarn sensor 18 and a cutter 19.

Besides, at the yarn end finding station D, an air flow controlling plate 21 is fixedly located near an outer periphery of a layer Y2 of a yarn of a bobbin 1*d* and extends in a direction of an axis of the bobbin. In particular, the air flow controlling plate 21 has, as seen in FIGS. 1 and 3, a length or height h substantially equal to the axial length of the yarn layer on the bobbin and extends in a slightly curved plane so as to partially cover an outer periphery of the yarn layer of the bobbin. A compressed air injection nozzle 22 is secured to a lower portion of the plate 21 and is connected via a pipe 26 to a compressed air supply source. The compressed air injection nozzle 22 has a compressed air injecting opening 23 formed therein and located between the outer periphery of the yarn layer Y2 and the plate 21. Thus, a flow P of compressed air injected upwardly from the opening 23 of the nozzle 22 will flow upwardly in a gap S between the outer periphery of the yarn layer Y2 and the plate 21. Accordingly, while a fluid injected from an opening is generally inclined to be diffused in the atmospheric air, such possible diffused flows turned away from the yarn layer will be checked and air flows directed upwardly along the outer periphery of the yarn layer will be increased.

It is to be noted that the smaller the gap S, the higher the effect thereof, and the plate 21 can be moved to and positioned at a suitable position by means of an elongated hole 25 formed in a fixing bottom plate 24.

Referring to FIGS. 1 and 3, a suction pipe 27 is located below a tray 2*e* at the station E next to the yarn end finding station D. At the position of the suction pipe 27, when a yarn Y3 extending between a bobbin 1*e* and the suction pipe 17 is cut at the position of the cutter 19, an end of the yarn on the bobbin side is sucked and inserted into a center hole 28 of the bobbin.

It is to be noted that the cutter 19 at the station E is operated by a drive source such as a rotary solenoid each time a tray is fed from the station D to the station E. The yarn sensor 18 is provided to detect presence or absence of a yarn Y3 extending between a bobbin 1*e* at the station E and the suction pipe 17, and a signal from the sensor 18 is coupled to control a movable guide 29 when a bobbin at the station E is moved to the discharging station F. In particular, in response to a yarn presence signal, the movable guide 29 is positioned to a broken line position at which a bobbin for which an end of a yarn has been successfully found is guided so as to be discharged from the discharging position F onto the transport path 9. On the contrary, in case the sensor 18 detects absence of a yarn, the movable guide 29 is positioned to a two dot chain line position. Consequently, the bobbin which arrives at a positon 29*a* is prevented from being discharged and is fed again to the yarn end finding station A via further stations G and H.

In such a yarn end finding device as described above, in case a bobbin 1*d* arriving at the station D has no top bunch thereon and has an end Y4 of a yarn sticking to an outer periphery of a yarn layer thereon, the yarn end on the bobbin cannot be sucked into the suction pipe 17 only by the pair of rotary rollers 11, 12 shown in FIG. 1. To the contrary, with the device of the present invention, compressed air injected from the opening of the nozzle 22 as illustrated in FIG. 2 will flow upwardly along a surface of a yarn layer Y2 while diffusion of air flows is prevented by the controlling plate 21. Consequently, the yarn end Y4 sticking to the surface of the yarn layer is blown upwardly by an air flow flowing along the outer periphery of the yarn layer and thus sucked into the opening 16 of the suction pipe 17 in a stand-by condition.

It is to be noted that while in the embodiment described above the air flow controlling plate 21 is provided fixedly only on one side of a bobbin, naturally it may otherwise be provided such that it may surround opposite sides or an entire circumference of a bobbin. Where the air flow controlling plate 21 extends over an entire circumference of a yarn layer of a bobbin, it may be formed as a tubular member including two semi-tubular sections wherein one of the two semi-tubular sections is opened relative to the other when a bobbin is to be placed into or removed from the tubular member.

Further, while in the embodiment described above the compressed air injection nozzle is located at a lower portion of the plate 21 so as to inject compressed air upwardly because the yarn end finding device of the present embodiment is applied to a yarn end finding device for a top bunch, similar effects could be attained also on a yarn end finding device for a bottom bunch, that is, a device for finding an end of a yarn on a bobbin which was bunch windings located at a lower end portion thereof if the compressed air injection nozzle 22 is located above the plate 21 so that compressed air may be injected toward a bottom end of a bobbin.

As apparent from the foregoing description, according to the present invention, finding of such an end of a yarn on a bobbin as sticks to an outer surface of a layer of the yarn on the bobbin is enabled. Accordingly, bobbins for which ends of yarns cannot be found by a conventional yarn end finding device for bunch windings on an end face of a bobbin are decreased, and finding of an end of a yarn is made possible for almost all of bobbins. Consequently, the working efficiency of a winder can be improved.

Now, a method of detecting successful finding of an end of a yarn by the yarn end finding device described above will be described with reference to FIGS. 4 to 10.

According to an embodiment of the present invention, in a step of introducing an end of a yarn on a bobbin into a center hole of the bobbin, the yarn is detected when it enters the center hole of the bobbin.

Figure 10:
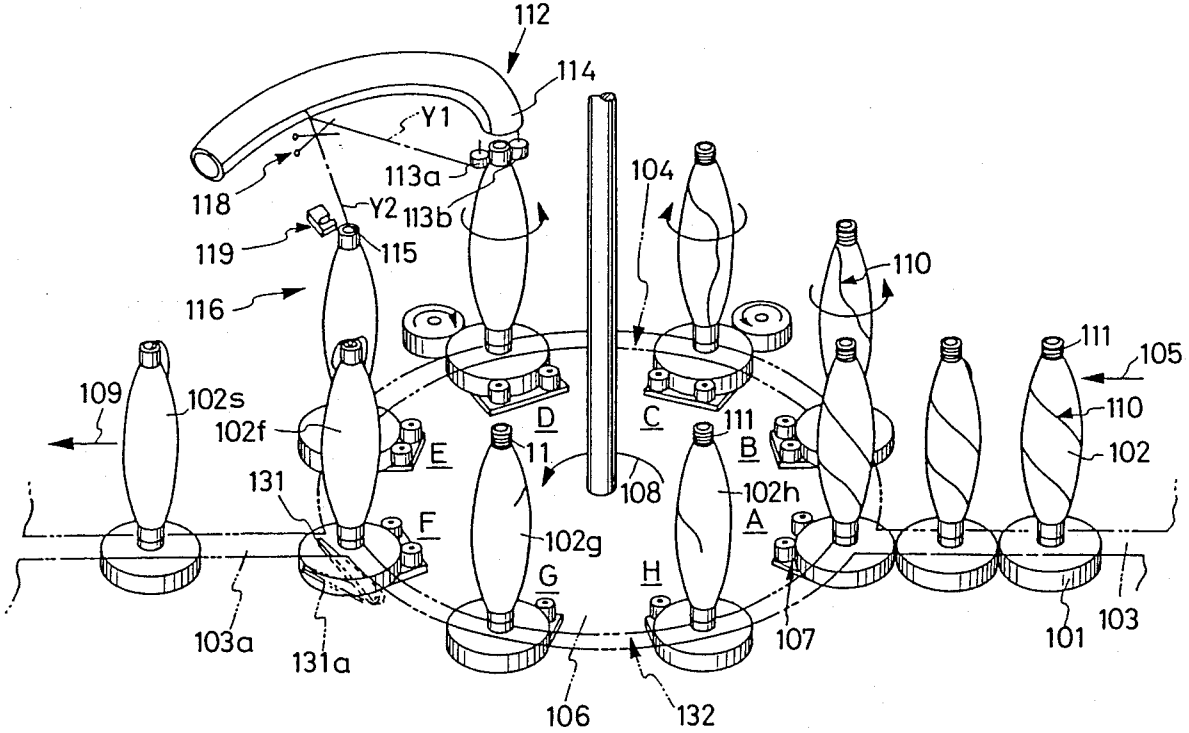

FIG. 10 shows an example of yarn end finding device for a so-called top bunch wherein bunch windings are formed at a head portion of a bobbin.

An annular feeding path 104 is provided between a pair of transport paths 103, 103*a* for bobbins 102 fitted on trays 101. The annular feeding path 104 is connected at an accepting station A position thereof to the carrying in path 103 and at a bobbin discharging station F position thereof to the carrying out path 103*a*. A portion of the annular feeding path 104, that is, stations from the station A to the station F make a yarn end finding processing path while the remaining portion, that is, stations F, G and H make a feedback path for a bobbin for which finding of an end of a yarn has failed.

A bobbin 102 produced on a spinning frame is fed in a direction indicated by an arrow mark 105 along the transport path 103 until it comes to the accepting position A of the yarn end finding device while it is fitted uprightly on a tray 101. The bobbin 102 accepted in one of tray accepting portions 107 formed in a fixed pitch on a rotary plate 106 of the yarn end finding device passes, as the rotary plate 106 is rotated intermittently in a direction of another arrow mark 108, several processing stations B, C, D and E and come to a discharging station F from which the bobbin for which an end of a yarn has been successfully found is transported in a direction indicated by a further arrow mark 109 along the other transport path 103*a* toward a winder.

At the station B, a cutter device for releasing a bottom bunch which device is provided only where bobbins having bottom bunches thereon are to be processed is not provided because in the present embodiment only bobbins having top bunches thereon are processed. Thus, a bobbin only waits at the station B. At the station C, a searcher mechanism is provided which searches a wrapped string of a yarn on a surface of a yarn layer called a back wind 110 on a bobbin 102. Thus, the searcher mechanism brings the bobbin 102 into a condition in which the back wind 110 floats above the surface of the yarn layer on the bobbin 102.

Then, at the station D, a device 112 for releasing and sucking a top bunch 111 is provided. For example, a pair of rollers 113*a*, 113*b* for contacting under pressure with a portion of a bobbin at the top bunch 111 are provided such that axes of rotation thereof are inclined slightly. Thus, as the rollers 113*a*, 113*b* are rotated, the top bunch 111 is released, and a string of the yarn let off a head portion of the bobbin is then sucked into a suction pipe 114 which has an opening formed therein and located near the head portion of the bobbin.

Further, at the station E, a yarn end inserting mechanism 116 is provided which cuts an end string of a yarn drawn out from a bobbin into a yarn segment of a fixed length and inserts an end of the yarn into a center hole 115 of the bobbin 102.

An example of the station E is shown in FIGS. 4 to 7. In particular, a yarn Y2 extending between a bobbin 102*e* positioned at the station E and the suction pipe 114 takes a certain fixed yarn route due to a tension caused by a sucking force of the suction pipe 114. A cutter device 118 is located at a preset position spaced from an upper end portion of a bobbin such that the yarn may be naturally introduced into the cutter device 118 as the yarn Y2 takes the yarn route, and a sensor 119 is located at such a position spaced a little distance from the yarn route Y2 that, only when an end of a yarn is inserted into the bobbin center hole 115 after cutting of the yarn by the cutter, part of the yarn may pass in the sensor 119 in order for the sensor 119 to detect presence or absence of a yarn. An exemplary one of mounting locations for a sensor which are determined by the requirement described above is a location between the bobbin 102*e* and the cutter 118 near the upper end portion of the bobbin below the yarn route. It is to be noted that the sensor 119 is preferably constituted from a photoelectric sensor from points of view of responsiveness, durability, reliability and so on while a photoelectric sensor, a sensor of the electric capacitance type, a sensor involving a piezoelectric element, a micro-switch of the hair type and some other sensors may be applied as the sensor 119.

Figure 5:
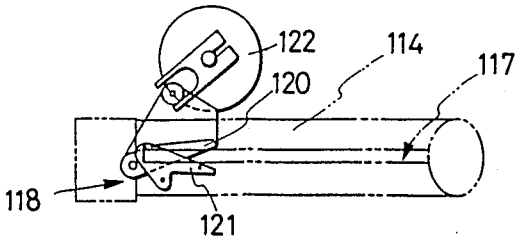

Meanwhile, an exemplary one of cutters which can be applied as the cutter device 118 is a cutter as shown in FIG. 5 which is constituted from a movable blade 120 and a fixed blade 121 located in an opposing relationship with a slit 117 of the suction pipe 114 located therebetween, and a rotary solenoid 122 for driving the movable blade 120.

Figure 7:
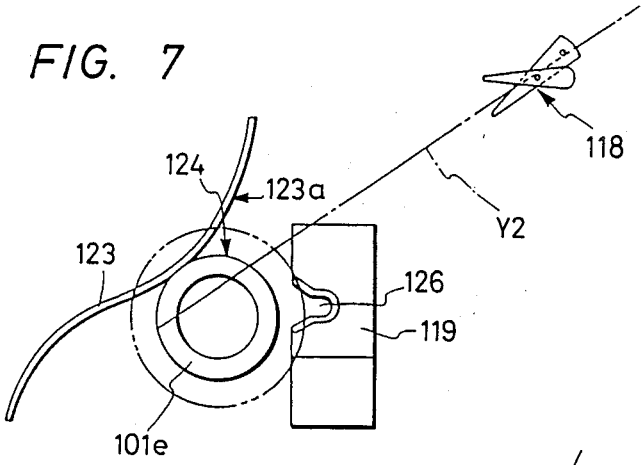
Figure 6:
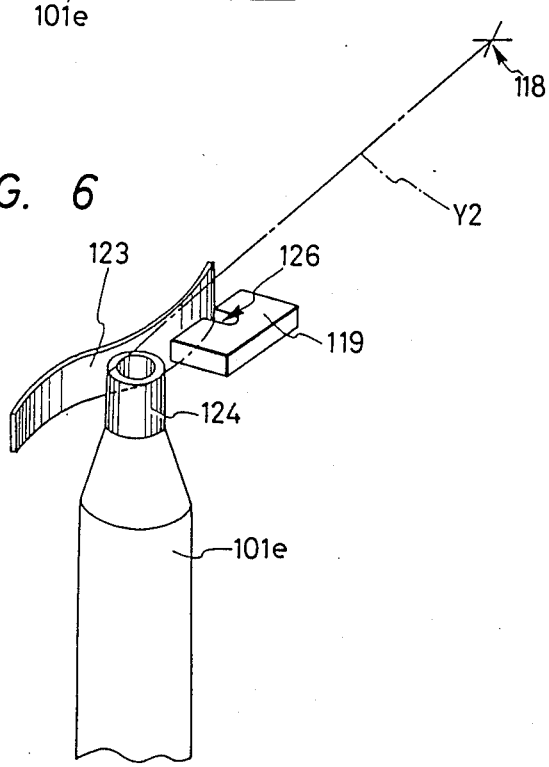

It is to be noted that reference numeral 123 in FIGS. 6 and 7 denotes a guide plate for positioning a bobbin 101*e*. The guide plate 123 has a smooth curved face 123*a* extending along a bobbin feeding path such that a head portion of a bobbin, that is, a portion 124 of the bobbin at which a top bunch is located is contacted under slight pressure with and thus positioned by the guide face 123*a* of the guide plate 123. Accordingly, a yarn drawn out by a sucking force to a yarn Y2 connecting to the suction pipe is held at a location at which the guide plate 123 and the bobbin are contacted with each other. Accordingly, there are effects that releasing of a yarn by an excessive amount is prevented and the yarn route between a bobbin and the suction pipe is controlled to a fixed position.

Figure 4:
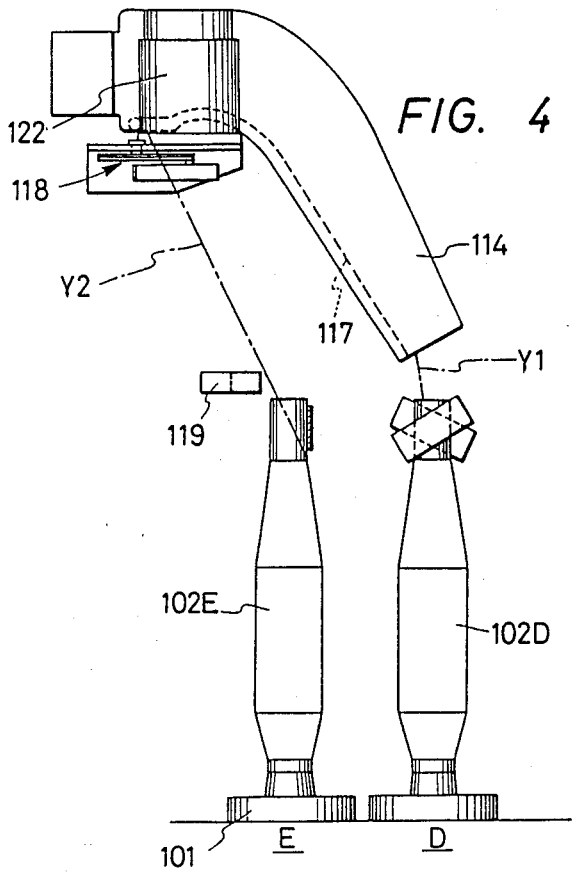

Accordingly, as shown in FIG. 4, directly after a bobbin has been moved from the station D to the station E, a yarn Y2 extending between a bobbin 102*e* and the suction pipe 114 has nothing to do with the sensor 119. Accordingly, in this condition, detection of presence or absence of a yarn inserted in the center hole of a bobbin is not effected.

Figure 8:
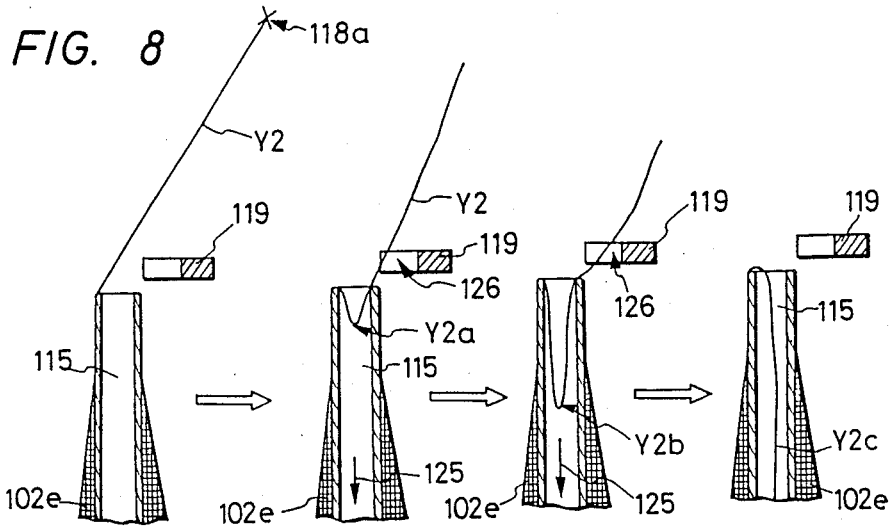
Figure 9:
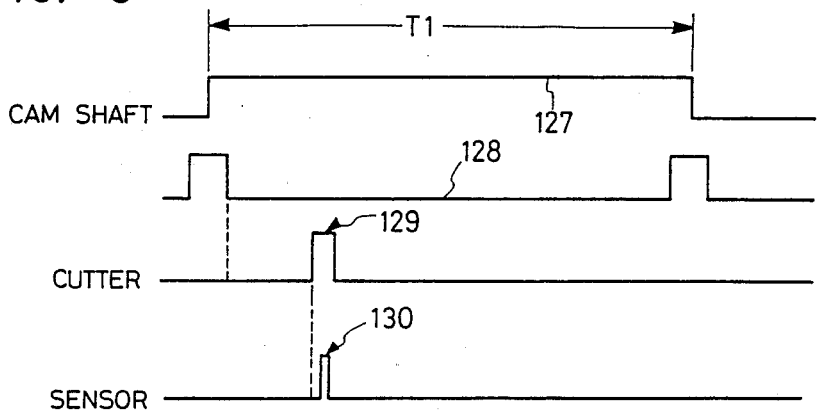

After the yarn has been positioned at the station E, the cutter 118 operates to cut 118*a* the yarn. Then, a yarn segment cut off and remaining on the suction pipe 114 side is sucked and removed into the suction pipe 114 while an end Y2 of the yarn of a fixed length on the bobbin 102*e* side is sucked and inserted into the bobbin center hole 115 by an action of a sucking air flow produced in a direction indicated by an arrow mark 125 as shown in FIG. 8. It is to be noted that the sucking air flow is produced by an action of an air passing hole formed in a tray 101 of FIG. 4 and a suction pipe not shown located below the tray.

A behavior of the yarn Y2 by a sucking action is illustratively shown in FIG. 8 wherein it is sucked into the bobbin center hole 115 from a portion Y2*a* thereof most near to an opening at the top end of the bobbin and is then further sucked Y2*b* by the sucking force passing in a yarn detecting groove 126 of the sensor 119 until it finally comes to a position Y2*c* in which it depends in the bobbin center hole 115 whereupon the yarn end inserting operation comes to an end. Accordingly, if the yarn passes in the sensor 119 even at a moment, insertion of the yarn end segment is determined. Thus, the sensor 119 detects a yarn Y2 just when the yarn Y2 enters the center hole 115 of a bobbin after the yarn has been cut by the cutter.

A timing chart of the operation described above is shown in FIG. 9. In particular, one rotation of a cam shaft not shown for controlling a yarn end finding operation of the yarn end finding device shown in FIG. 10 is indicated by a time T1 of a line 127. The time T1 is a time in which a bobbin 102D which has been stopped once, for example, at the station D undergoes a yarn end finding process and is then moved to and stopped at the station E. Another line 128 indicates an operation timing of a contactless switch for detecting one complete rotation of the cam shaft. Accordingly, if one cycle of the cam shaft is started from a condition of FIG. 4 in which a yarn Y2 extends between a bobbin 102*e* and the suction pipe 114 at the station E, the cutter 118 is operated after a delay of a certain interval of time which is presettable by a timer so that a yarn end is sucked and inserted into the center hole 115 of the bobbin whereupon the sensor 119 detects 130 the yarn. After a fixed interval of time after operation of the cutter 118, the bobbin 102*e* at the station E is fed to the station F at which the movable guide 131 of FIG. 10 located at the station F is moved to a two dot chain line 131*a* in response to a signal 130 from the sensor 119. Consequently, the bobbin 102*f* at the station F for which an end of a yarn has been successfully found is discharged to the transport path 103*a*.

Meanwhile, in case the sensor 119 has not detected a yarn from a bobbin, when the bobbin arrives at the station F, the guide 131 remains in its closed position. Consequently, the bobbin is not discharged from the station F, and when a subsequent yarn end finding operation is started, the bobbin at the station F is moved to the station G on the feedback path 132. Thus, a bobbin 102*g* or 102*h* at the station G or H is either a bobbin on which there still remain bunch windings 111 or a bobbin which has bunch windings released therefrom but for which insertion of a yarn end thereof into the bobbin center hole 115 has failed for some causes.

It is to be noted that while in the embodiment described above a system has been described which finds an end of a yarn on a bobbin having a top bunch thereon while the bobbin remains fitted on a tray or is fed intermittently along a certain fixed feeding path, naturally the present invention can be applied not only to the system described above but also to other various types of yarn end finding devices including a type wherein a yarn end is found while a bobbin is held stopped at a fixed position and another type wherein a yarn is introduced to a cutter device making use of a free dropping motion of a bobbin.

As apparent from the foregoing description, according to the present invention, an end of a yarn is detected, in a step of inserting the yarn connecting to a layer of the yarn on a bobbin into a center hole of the bobbin, by a sensor when it enters the center hole of the bobbin. Accordingly, inspection whether or not an end of a yarn is inserted to a predetermined position can be effected with a high degree of accuracy. Thus, the problem of the conventional yarn end finding device described hereinabove can be resolved.

What is claimed is:

1. A device for finding an end of a yarn wound about a bobbin having a layer of yarn wound thereon, a center hole and a bunch winding location, the device comprising:

first yarn end finding means for finding a yarn end wound about the bunch winding location of the bobbin;

second yarn end finding means for finding a yarn end, suspended on the layer of yarn, the second yarn end finding means having an air flow controlling plate located near an outer periphery of a layer of a yarn on a spinning bobbin at a yarn end finding position and extending in a direction of an axis of the spinning bobbin, and a compressed air injection nozzle located in a gap between said air flow controlling plate and the yarn layer on the spinning bobbin; and inserting means or inserting the found yarn end in the center hole of the bobbin.

2. The device as claimed in claim 1, wherein said air flow controlling plate has a length substantially equal to the axial length of the yarn layer on the bobbin and extends in a slightly curved plane so as to cover an outer periphery of the yarn of the bobbin.

3. The device as claimed in claim 1, wherein the first yarn end finding means comprises a pair of rotary rollers for releasing a bunch winding, the rotary rollers having axes of rotation which are inclined by individual certain angles relative to an axis of a bobbin, the rotary rollers are provided at the yarn end finding position and are arranged to hold an upper end portion of a take-up tube of a bobbin between the rollers and to release the bunch winding at the upper end of the take-up tube by an action of the rotation of the rollers rotated in opposite directions.

4. The device as claimed in claim 1, further comprising:

a suction pipe for sucking an end of a yarn, the suction pipe being located at the yarn end finding position;

a cutter for cutting a yarn extending between a bobbin and the suction pipe to provide a cut yarn end extending from the bobbin, wherein the inserting means includes means for inserting the cut yarn end extending from the bobbin into the center hole of the bobbin; and a sensor for detecting whether the cut yarn end is inserted in the center hole of a bobbin;

wherein the cutter, the inserting means, and the sensor are provided at a subsequent yarn end inserting position to the yarn end finding position.

5. The device as claimed in claim 4, wherein said sensor is a photoelectric sensor.

6. A device for finding an end of a yarn connecting to a layer of the yarn wound about the axis of a bobbin and for inserting the end of the yarn into a center hole of the bobbin, the device comprising:

an air flow controlling plate located near the outer periphery of the layer of yarn on the spinning bobbin and extending in a direction of the axis of the spinning bobbin;

an air injection nozzle located in a gap between said air flow controlling plate and the yarn layer on the spinning bobbin;

a suction pipe for sucking an end of the yarn to provide a path of yarn extending between the bobbin and the suction pipe;

a cutter for cutting the yarn extending between the bobbin and the suction pipe;

inserting means for inserting the cut yarn into the center hole of the bobbin; and a sensor for detecting whether the cut yarn is inserted in the center hole of the bobbin;

wherein the yarn extending between the bobbin and the suction pipe defines a yarn route, and wherein said sensor is located at such a position spaced from the yarn route that only when an end of a yarn is inserted into the center hole of a bobbin after cutting of the yarn by the cutter, part of the yarn may pass in the sensor in order for the sensor to detect the presence or absence of a yarn.

7. The device as claimed in claim 6, wherein a guide plate for positioning a bobbin has a smooth curved guide face arranged to contact a portion of a bobbin under slight pressure to hold a yarn drawn out of the yarn layer by a sucking force of the suction pipe.

8. A method of detecting an end of yarn found on a spinning bobbin, the method comprising the steps of:

inserting an end of yarn connecting to a layer of a yarn on a bobbin into a center hole of the bobbin, and detecting the yarn end as it enters the center hole of the bobbin.

9. A device for finding a yarn end of a yarn layer wound about the winding periphery of a bobbin, the bobbin having a bunch winding location provided at one end of the winding periphery, the device comprising:

a first yarn end releasing means operable for releasing a yarn end at the bunch winding location of the bobbin;

a second yarn end releasing means operable for releasing a yarn end from the yarn layer wound about the winding periphery of the bobbin, the second yarn end releasing means having an air flow controlling plate arranged adjacent and spaced from the winding periphery of the bobbin so as to form a gap therebetween, and an air flow projecting means for projecting an air flow within the gap; and gap adjusting means for adjusting the size of the gap by adjusting the relative distance between the air flow controlling plate and the winding periphery of the bobbin.

10. A device as claimed in claim 9, wherein the air flow projecting means comprises an air injection nozzle arranged to direct an air flow within the gap, substantially parallel to the winding periphery of the bobbin, and toward the bunch winding location of the bobbin.

11. A device as claimed in claim 10, further comprising:

a suction pipe for sucking an end of a yarn released by at least one of the first and second yarn releasing means so as to provide a yarn path extending between the bobbin and the suction pipe.

12. A device as claimed in claim 11, wherein the bobbin is provided with a center hole, the device further comprising a cutter for cutting a yarn in the yarn path extending between the bobbin and the suction pipe, and means for inserting the cut yarn into the center hole of the bobbin.

13. The device as claimed in claim 12, further comprising a sensor for sensing the cut yarn as it is inserted into the center hole of a bobbin.

* * * * *